US009045845B2

(12) United States Patent
Conesa et al.

(10) Patent No.: US 9,045,845 B2
(45) Date of Patent: Jun. 2, 2015

(54) COMPOSITE YARN, METHOD FOR OBTAINING SAME AND RESULTING TEXTILE STRUCTURE

(75) Inventors: Isabelle Conesa, Saint Romain de Jalionas (FR); Laurence Pollet, Lyons (FR); Philippe Berge, Jonage (FR)

(73) Assignee: Chavanoz Industrie, Chavanoz (FR)

( * ) Notice: Subject to any disclaimer, the term of this patent is extended or adjusted under 35 U.S.C. 154(b) by 0 days.

(21) Appl. No.: 12/585,662

(22) Filed: Sep. 21, 2009

(65) Prior Publication Data

US 2010/0089017 A1 Apr. 15, 2010

Related U.S. Application Data

(63) Continuation-in-part of application No. 10/499,810, filed as application No. PCT/FR02/04577 on Dec. 27, 2002, now abandoned.

(30) Foreign Application Priority Data

Dec. 28, 2001 (FR) ..... 01 17047

(51) Int. Cl.
*B05D 1/26* (2006.01)
*B05D 1/36* (2006.01)
(Continued)

(52) U.S. Cl.
CPC ..... *D02G 3/404* (2013.01); *B05D 1/265* (2013.01); *D02G 3/44* (2013.01); *D02G 3/443* (2013.01); *D10B 2503/02* (2013.01)

(58) Field of Classification Search
CPC ..... B05D 1/26; B05D 1/265; B05D 1/36; D01D 11/02; D02G 3/36
USPC ..... 264/103, 135, 136, 137, 171.1, 171.13, 264/171.24; 427/407.1, 407.2, 407.3, 427/412.1, 412.5, 434.6, 434.7
See application file for complete search history.

(56) References Cited

U.S. PATENT DOCUMENTS 2,224,274 A 12/1940 Powers
2,392,805 A 1/1946 Biefeld
(Continued)

FOREIGN PATENT DOCUMENTS

FR A-2448554 9/1980
FR 2819434 A1 * 7/2002
(Continued)

OTHER PUBLICATIONS

Written Opinion of the International Searching Authority dated Sep. 21, 2010 for International Application No. PCT/EP2010/063922.
(Continued)

*Primary Examiner* — Leo B Tentoni
(74) *Attorney, Agent, or Firm* — Oliff PLC

(57) ABSTRACT

A composite yarn for technical or industrial use, particularly suitable for textile webs, is uniformly coated with a polymer and exhibits improved fir behavior and improved resistance to sheath stripping. The yarn may be obtained by a process where a continuous yarn, obtained by spinning a large number of fibers, such as about 100 to 600 fibers made of an organic or inorganic material, of a suitable yarn diameter, such as between about 1 to 10 micrometers, is subjected to a process for mechanically opening the yarn by splaying, to uniformly spread out and separate the fibers, including inner layers of the fibers, without impairing functional properties of the yarn, simultaneously with or prior to coating of the fibers by a polymer material having a viscosity between 1000 and 10,000 mPa·s, and formed to have a circular cross-section and uniformly distributed fibers throughout the cross-section of the polymer material to limit desheathing of the yarn.

22 Claims, 1 Drawing Sheet

(51) Int. Cl.

| | |
|---|---|
| ***D01D 11/02*** | (2006.01) |
| ***D02G 3/36*** | (2006.01) |
| ***D02G 3/40*** | (2006.01) |
| ***D02G 3/44*** | (2006.01) |

(56) References Cited

U.S. PATENT DOCUMENTS

| | | | | |
|---|---|---|---|---|
| 3,298,854 | A | 1/1967 | Marzocchi et al. | |
| 3,508,990 | A | 4/1970 | Marzoocchi | |
| 3,551,269 | A | 12/1970 | Marzocchi | |
| 3,761,346 | A | 9/1973 | Caroselli et al. | |
| 3,770,768 | A | 11/1973 | Holub et al. | |
| 3,944,717 | A | 3/1976 | Hacker et al. | |
| 4,159,618 | A | 7/1979 | Sokaris | |
| 4,539,232 | A * | 9/1985 | Burzynski et al. | 427/407.1 X |
| 4,994,303 | A | 2/1991 | Calkins | |
| 5,206,085 | A | 4/1993 | Nakagawa et al. | |
| 5,462,803 | A | 10/1995 | Wessels | |
| 5,889,087 | A | 3/1999 | Hayashi et al. | |
| 6,032,454 | A | 3/2000 | Damour et al. | |
| 6,049,956 | A | 4/2000 | Lifke et al. | |
| 6,255,594 | B1 | 7/2001 | Hudson | |
| 2004/0043213 | A1 * | 3/2004 | Tonon | 264/171.1 X |
| 2005/0042447 | A1 | 2/2005 | Conesa et al. | |
| 2007/0048523 | A1 | 3/2007 | Pollet et al. | |

FOREIGN PATENT DOCUMENTS

| | | |
|---|---|---|
| JP | A-58-185637 | 10/1983 |
| JP | A-60-28529 | 2/1985 |
| JP | 2001-348756 A | 12/2001 |
| WO | WO 94/12707 | 6/1994 |

OTHER PUBLICATIONS

International Search Report for Application No. PCT/EP2010/063922 dated Sep. 21, 2010.

Torta, P.G. and B.J. Collier, Understanding Textiles, Fifth Edition, Prentice Hall, 1997, pp. 2-5.

Canadian Office Action issued Sep. 25, 2009 for Canadian Patent Application No. 2,470,453.

* cited by examiner

COMPOSITE YARN, METHOD FOR OBTAINING SAME AND RESULTING TEXTILE STRUCTURE

This Application is a Continuation-in-Part of application Ser. No. 10/499,810 filed Jun. 22, 2004, now abandoned, which was a U.S. National Stage of International Application No. PCT/FR/04577 filed Dec. 27, 2002.

The present invention relates to a composite yarn for technical or industrial use, that can be assembled into all types of textile structure, especially textile webs suitable for meeting any particular application or specification, for example for the manufacture of blinds or curtains. More particularly, the invention relates to composite yarns that can be obtained by coating.

Already generally known, and as manufactured and sold by the Applicant, are technical composite yarns comprising:

- a core comprising a continuous yarn, especially made of an inorganic material such as glass, or an organic material such as polyester, polyamide or polyvinyl alcohol, and
- a sheath or jacket comprising a matrix consisting of at least one chlorinated polymer material, for example a polyvinyl chloride (PVC), a fire-retardant mineral filler, incorporated into and distributed within said matrix, and a plasticizer.

The yarn itself generally includes several, typically a great number, of continuous filaments or of fibers. When the yarn is of natural origin, a yarn is obtained by twisting fibers, that is to say by spinning. It may be cotton or flax. The material used in the production of technical textiles, and in particular in the manufacture of blinds or curtains, is more generally of synthetic origin or made of glass. Therefore, the chemical nature of the yarn may be organic and of synthetic origin, and it may consist of any plastic material that can be spun, for example polyolefins, polyesters, polyamides, polyvinyls, acrylics. It may also be of inorganic origin, for example made of glass or silica. For synthetic or inorganic material, use is sometimes made of fiber to designate the yarn, and of filament or continuous filament to designate the elements that are assembled to form the yarn or fiber, generally by twisting. However, by sake of consistency, the term fiber will be used to designate the element that constitutes the yarn, say the yarn is made by spinning fibers.

For example, the number of fibers, especially in synthetic or inorganic yarns, is generally from 100 to 600, and more particularly from 200 to 400. The diameter of these fibers is generally between 1 and 10 micrometers, and more particularly between 3 and 9 micrometers.

Preferably, but not exclusively, such a yarn is obtained by coating, in one or more layers, the core with a plastisol comprising the chlorinated polymer material, for example polyvinyl chloride, and the plasticizer, and then by gelling the plastisol around the core.

The technical fabrics obtained with such yarns, and when they are used in various environments, especially for the equipping both inside and outside of buildings or constructions, for example as blinds, have to meet requirements regarding fire behavior that are defined by national or international regulations and/or homologation or authorization procedures.

Thus, the regulations applicable to such fabrics in the German Federal Republic define various classes that are characterized in particular by the specimen length destroyed by fire, and by the temperature of the combustion smoke, said classes being identified by the letters B1 to B3, the letter B1 characterizing the best fire behavior that can be obtained by a material containing organic matter.

The regulations applicable in France also define various classes according to the NF 1601 and NF P 92503 standards, on the one hand, characterized especially by the emission of smoke and identified by the letters F0 to F5, F3 being the best behavior that can be obtained by a material containing a halogenated polymer, and, on the other hand, characterized in particular by the residual ignition temperature of the fabric and identified by the letters M0 to M4, the letter M1 identifying the best fire behavior that can in general be obtained by a material containing organic matter.

Various attempts have been made to improve the intrinsic fire behavior of these composite yarns, for example by using particular plasticizers such as organic phosphates. Unfortunately, the use of such plasticizers degrades the functional properties (flexibility, slipability, etc.) of these yarns, which impairs their subsequent weaving, and makes the latter more difficult. Moreover, the incorporation of such plasticizers increases the smoke index.

With regard to the performance of the actual fire-retarding filler, various documents have proposed diverse types of compounds or compositions that can improve the fire behavior of plastic matrices in which the fire-retarding filler has been incorporated, but without the application or the forming of the fire-retarded plastic, for example in the form of a yarn, being specified.

Thus, document JP-A-58185637 has proposed, for a matrix based on polyvinyl chloride, a fire-retarding filler comprising a chlorinated polyethylene, a compound chosen in particular from antimony and aluminum oxides and/or hydroxides, and preferably another compound chosen from zinc salts, including zinc borate, and tin-based products, for example zinc stannate.

Document FR-A-2 448 554 has proposed, again for a matrix based on polyvinyl chloride and also incorporating a stabilizer, a plasticizer consisting of a phosphoric ester, and an alumina hydroxide filler, a fire-retarding filler comprising an antimony oxide, optionally combined with a zinc borate.

None of the fire-retarding fillers proposed above is suitable for improving to the desired extent the fire behavior of a composite yarn as considered above, and without degrading its other properties, for example mechanical properties.

Nor is it possible to significantly increase the weight proportion of fire-retarding filler, except at the expense, as above, of degrading the functional properties of the composite yarn.

In addition, the yarns must have special mechanical properties according to their subsequent. In particular, for the production of technical textiles, enabling them to be woven under satisfactory conditions, for example, abrasion resistance and tensile strength and, for example, resistance to defibrillation when cut. Other special mechanical properties allow fabrics to be obtained that comply with the specifications required for the final textiles, for example, light-screening properties and therefore fiber opacity, and weatherability when these textiles are to be used to provide external fittings to buildings, for example, blinds, but also density, it being easier to install and handle them if their weight is reduced.

Concerning abrasion resistance, reference will be made for example to sheath stripping. Since the core of the yarn is not uniformly distributed in the polymeric sheath the core can leave the sheath under the effect of abrasion, and breaks can occur in the fibers forming the core, it being possible for these to break by repeated rubbing on account of their contact between one another.

Glass fibers, and silica fibers as well, are often used as the material of yarns in the production of blinds or curtains. The nature of these fibers makes them and the yarn sensible to mechanical constraints, in particular during the spinning, weaving and any other processes or steps that imply mechanical constraint or deformation thereon. It must also be considered that in the spinning industry, the process speeds are quite high due to the nature of this industry. Any improvement in the manufacture of yarns has to consider the mechanical resistance of the yarn and of the constituting fibers, in order to avoid any damaging or even break of them.

The subject of the present invention is a coated composite yarn exhibiting, overall and intrinsically, improved fire behavior, thus favoring the dissipation of heat and making it possible to greatly reduce the random phenomenon of flame propagation measured by fire tests according to the NF P 92 503 standard on any fabric obtained from the composite yarn according to the invention.

The temperature withstand properties are improved owing to the uniform distribution of the fibers within the polymer coating material that allows the heat to be dissipated since, when the fibers are grouped together, they constitute a preferential conduction path that promotes heat propagation.

The subject of the invention is also a coated composite yarn exhibiting an improved resistance to sheath stripping and its consequences on yarn resistance.

The subject of the invention is a composite yarn consisting of a continuous yarn, obtained by spinning fibers made of an organic or inorganic material or natural fibers, such as flax or cotton fibers, and of a polymer material, characterized in that the constituent fibers of said continuous yarn are uniformly distributed within said polymer material in such a way that each of said fibers is coated by said polymer material.

This composite yarn can be used by itself or as a core for the manufacture of composite yarns obtained by a second coating with a polymer material.

The subject of the present invention is also a coated composite yarn that can be obtained by a process for coating with a polymer material, characterized in that it comprises a core consisting of a composite yarn as defined above and in that the polymer material formed around the core and the constituent polymer material of the core are of the same nature.

Depending on the required fire behavior characteristics, this composite yarn can be used as a core for the manufacture of fire-retarded composite yarns obtained by coating with polymers containing fire-retarding fillers.

Thus, yarns exhibiting overall and intrinsically improved fire behavior using less fire-retarding filler are obtained.

The subject of the present invention is also a coated fire-retarded composite yarn that can be obtained by a process for coating with a polymer material containing a fire-retarding filler, characterized in that it comprises a core consisting of a composite yarn as defined above and in that the polymer material formed around the core and the constituent polymer material of the core are of the same nature.

According to the invention, said coating can be carried out using a liquid monomer or polymer preparation; for example, a liquid polymer preparation is obtained by melting a polymer or by dispersing a polymer, for example in the form of a plastisol; and, for example, a liquid monomer preparation consists of a liquid monomer that will polymerize through the effect of heat or by irradiation, for example UV irradiation.

The invention also relates to a process for manufacturing a composite yarn, characterized in that a continuous yarn, obtained by spinning fibers made of an organic or inorganic material or natural fibers, is subjected to a process for mechanically opening the yarn that allows said fibers to be separated, simultaneously with or prior to its coating by a polymer material.

The invention furthermore relates to a process for manufacturing a composite yarn, characterized in that a continuous yarn, obtained by spinning fibers made of an organic or inorganic material or natural fibers, is subjected to a process for mechanically opening the yarn that allows said fibers to be separated, simultaneously with or prior to a primary coating with a liquid monomer preparation or a polymer preparation in the liquid state, and in that the composite yarn obtained is subjected to a second coating with a liquid monomer or polymer preparation.

Preferably, the monomer or polymer of the second coating is of the same nature as the monomer or polymer of the first coating.

The invention furthermore relates to a process for manufacturing a fire-retarded composite yarn, characterized in that a continuous yarn, obtained by spinning fibers made of an organic or inorganic material or natural fibers, is subjected to a process for mechanically opening the yarn that allows said fibers to be separated, simultaneously with or prior to a primary coating with a liquid monomer preparation or polymer preparation in the liquid state that does not contain a fire-retarding filler, and in that the composite yarn obtained is subjected to a second coating with a liquid monomer preparation or polymer preparation in the liquid state containing a fire-retarding filler.

The expression "mechanically opening" is understood to mean any process for opening the fibers, simultaneously with or prior to the coating operation, such as splaying the fibers, by applying an air jet or a water jet, an ultrasonic treatment, the application of mechanical pressure, for example to flatten the yarn, or any process for separating the fibers in order to allow the polymer material to penetrate the constituent fibers of said yarn. Splaying the fibers or applying an air jet, a water jet or an ultrasonic treatment are preferred methods, which provide better results than flattening, in particular due to the great number of fibers forming the yarn.

In one preferred embodiment, the opening of the yarn may be obtained by splaying. By splaying is meant that the yarn is forced to adopt a path such that it rubs against obstacles and tends to spread out in order to reduce the tension exerted on each filament. Such splaying must be done under sufficient tension for the fibers to spread out with respect to one another, but this tension must not be too high as the fibers cannot spread out further, and the risks of filament fracture increase.

In one particular embodiment, the splaying may be obtained by passing the fibers around part of the circumference of at least one thin rod or needle placed perpendicular to the path of the fibers.

In other words, the rod or rods placed along the path of the fiber form chicanes around which the fiber has to pass. By passing around them, the yarn has a tendency to open, and the various fibers spread out to occupy most of the line of contact with the rod.

The number, the shape and the separation of the various rods are determined according to the linear density of the yarns and their type, for example, the number of fibers per yarn.

In an alternative embodiment, the splaying may be combined with a vibrating treatment. When the vibrations are generated at a resonant frequency of the fiber, they cause the yarn to open. The splaying rods may, for example, be coupled to a source of vibration, thereby allowing the yarn opening effect due to the rubbing on the rods to be combined with the opening effect due to the vibrations.

Thus, the yarn will be deformed by spreading out its various fibers as much as possible in order to allow each fiber to be covered with the plastisol layer, including the fibers located at the core of the yarn, after impregnation.

The applicant has surprisingly found that, the first coating around the fibers, the one used to produce the core, may further comprise a fire-retardant filler. This allows one to further improve the fire-retarding properties. The filler may be added without impairing the mechanical properties of the yarn, and in particular without substantial risk of fiber abrasion.

Another subject of the invention is a composite yarn consisting of a continuous yarn, obtained by spinning fibers made of an organic or inorganic material or natural fibers, such as flax or cotton fibers, and of a polymer material, wherein the polymer material comprises a filler, preferably a fire-retardant filler, and wherein the constituent fibers of said continuous yarn are uniformly distributed within said polymer material in such a way that each of said fibers is coated by said polymer material. The process of manufacturing this subject-matter is the same as above, with the exception that the filler is present in the liquid monomer preparation or the polymer preparation in the liquid state that is used to produce the coating polymer. In an embodiment, the yarn is made of inorganic, especially glass, or organic and synthetic material.

In an embodiment, this composite yarn also comprise a second coating around the core, as explained before.

In an embodiment, after the opening of the yarn and the impregnation with the liquid monomer preparation or the polymer preparation in the liquid state, the yarn is passed through a small opening or die whose diameter is close to the desired core diameter. Preferably, the hole or die has such a diameter that allows to reassemble the yarn after the opening and/or to avoid the presence of a polymer coating around, say at the surface of the core.

In an embodiment, the method of preparation of the composite yarns according to the invention comprise one or two coatings, with or without fillers in one or the two coatings, and a) The fibers made of an organic or inorganic material are subjected to a process for mechanically opening prior to or during the coating of the yarn that allows said fibers to be separated and well distributed within said polymer material in such a way that each of said fibers is coated by said polymer material.
b) Then the core is passed through said die;
c) The rate of production is such that the shear rate of the die is between 60,000 and 120,000 $s^{-1}$;

The method of the present invention could further comprise a second coating process.

In one embodiment, the viscosity of the liquid monomer preparation or the polymer preparation in the liquid state, containing or not a filler, is comprised between 1,000 and 2,000 cPo.

In an embodiment, the coating of the fibers is obtained in a suitable die having very small diameter. The small diameter prevents the formation of a polymer sheath around the fibers.

The rate of production is such that the shear rate in the dies is between 60,000 and 120,000 $s^{-1}$.

Applicant has thus found that it is possible to obtain a composite yarn comprising one or two coatings, each of them being with or without fire-retardant filler, by using a die of very small diameter, high shear rate and polymeric material of high viscosity without any degradation of the core and without any degradation of the properties of the yarn obtained.

The yarn according to the invention exhibits none of the desheathing and shading phenomena observed in the yarns of the prior art.

These results are obtained without impairing the functional properties of the actual yarn, that are required for weaving it, and these properties are even improved. Thus, the fabrics obtained by weaving these composite yarns are better protected from foul weather, by the elimination or reduction in capillary wicking, and are easier to cut by elimination of defibrillation phenomena that occur on cutting.

The expression "liquid monomer or polymer preparation" is understood to mean any liquid formulation based on monomers or polymers.

The term "formulation" is understood to mean any compound comprising at least one product, for example a dispersion, solution or mixture of monomers and/or oligomers.

The term "polymer dispersion" is understood to mean any polymer preparation in the divided state containing additives in an organic liquid or otherwise.

The term "plastisol" is understood to mean a dispersion of polymers, fillers and other additives, in a finely divided state, in a plasticizer.

As polymer material, it is possible to use chlorinated polymers, silicones, polyurethanes, acrylics, ethylene/vinyl acetate EVA copolymers and ethylene-propylene-diene monomer EPDM terpolymers.

As an example of a chlorinated polymer material, it is possible to use, according to the invention, any PVC resin that can be plasticized and especially one that can be employed in the form of a plastisol.

The term "chlorinated polymer material" is understood to mean a pure chlorinated polymer or a copolymer of vinyl chloride copolymerized with other monomers, or else a chlorinated polymer that is alloyed with other polymers.

Among monomers that can be copolymerized with vinyl chloride, mention may in particular be made of: olefins, such as for example ethylene; vinyl esters of saturated carboxylic acids, such as vinyl acetate, vinyl butyrate or maleates; halogenated vinyl derivatives, such as for example vinylidene chloride; and acrylic or methacrylic acid esters, such as butyl acrylate.

As chlorinated polymer, mention may in particular be made of polyvinyl chloride, and also superchlorinated PVCs, polyvinylidene chlorides and chlorinated polyolefins.

Preferably, but not exclusively, the chlorinated polymer material according to the present invention has a halogen weight content of between 40 and 70%.

In one embodiment, the first coating around the fibers, i.e. the one used to produce the core, is made to comprise such a chlorinated polymer material and contains a fire-retardant filler. In a preferred embodiment, the chlorinated polymer material is or comprises polyvinyl chloride PVC.

According to the invention, it is possible to use, as silicone polymer material, organopolysiloxanes and more particularly polysiloxane resins and elastomers with or without a diluent.

According to the invention, it is possible to use, as polyurethane polymer material, any material formed from a hydrocarbon chain containing the urethane or—NHCOO— unit.

As regards the continuous yarn, this itself consists of one or more continuous filaments or fibers. Its chemical nature may be organic, for example made of polyester, polyamide, polyvinyl, or acrylic, of natural origin, such as flax or cotton, or inorganic, for example made of glass or silica, it being understood that its melting point must be above that at which the polymer material is processed.

The fire-retarding filler is chosen from the group formed by zinc borate, aluminum hydroxide, antimony trioxide, magnesium trioxide and zinc hydroxystannate, molybdenum compounds, halogenated derivatives, compounds containing active halogens, phosphorus compounds, and intumescent systems.

Other fillers may be incorporated and distributed within the liquid monomer or polymer preparation, in addition to the fire-retarding filler, for example a pigmenting filler, silica, talc, glass beads and/or a stabilizer. In such a case, the total composition by weight of the composite yarn, in terms of inorganic materials, is obviously modified or affected.

In the case of the use of a plastisol, thanks to the invention it remains possible to use conventional plasticizers, for example comprising at least one phthalate (including the known phthalate substitutes), and consequently not to compromise the functional properties of the yarn, with regard to its subsequent weaving.

The invention also makes it possible to limit the weight of fire-retarding filler, in proportions not exceeding 50% of the plastic matrix. Above 50%, the properties, especially mechanical properties, of the composite yarn are impaired. One prefers not to exceed 40% of fire-retarding filler.

All the technical characteristics of the yarn are improved. More particularly, the uniform distribution of the polymer material formed around the core, the resistance to capillary effects, the homogeneity of the shades, and the bonding of the sheath to the core should be noted.

In the case of the use of a PVC plastisol, the addition of a bonding agent of the isocyanate type is unnecessary.

Figure 1:
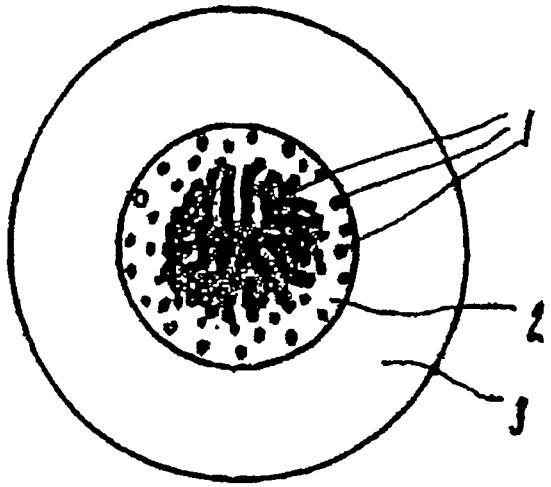
FIG. 1 shows in cross section a fire-retarded composite yarn of the prior art.
Figure 2:
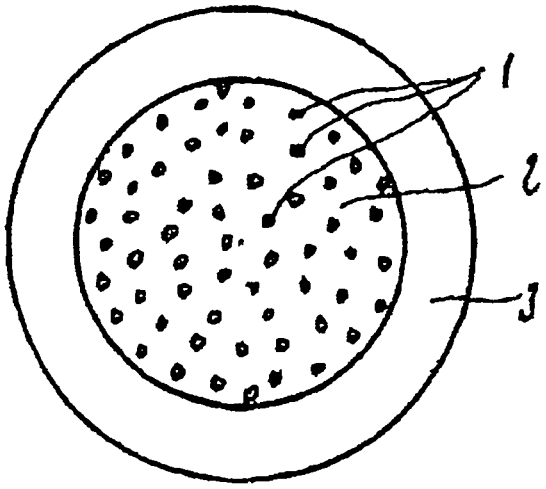
PRIOR ART FIG 2
FIG. 2 shows in cross section a fire-retarded composite yarn according to the invention.

Uniform distribution of the fibers 1 within the monomer or polymer preparation 2 applied in the liquid state and cooled or polymerized after application may be observed. The secondary coating 3 is also uniformly distributed in the composite yarn according to the invention.

The following comparative table illustrates all these characteristics, by comparison with a conventionally coated yarn, in the particular case of the use of a chlorinated polymer material, namely PVC.

| | Standard Coating | Coating according to the invention |
|---|---|---|
| Yarn | Twist >40 turns | Possibility of using twists <40 turns |
| 1st coating | 1 500 mPa · s fire- retarded PVC plastisol:<br>PVC resin = 100 phr<br>filler (fire-retardant) content = 15 to 25 phr<br>plasticizer content = 30 to 50 phr<br>stabilizers = 2-10 phr | 30 mPa · s plastisol:<br>PVC resin = 100 phr<br>filler content = 0<br>plasticizer content = 60 to 70 phr<br>stabilizers = 2-10 phr<br>Degree of application = 65 to 90% |
| $2^{nd}$ coating | Fire-retarded PVC plastisol identical to the first coating | 1500 mPa · s fire-retarded PVC plastisol; degree of application = 30 to 50%:<br>PVC resin = 100 phr<br>filler (fire-retardant) content = 15-25 phr<br>plasticizer content = 30-50 phr<br>stabilizers = 2-10 phr |
| Properties of the coated yard | LOI = 30.7%:<br>slight shading<br>slight desheathing<br>fire-retardant content = 8 to 15%<br>$1^{st}$ coating: +45% PVC<br>$2^{nd}$ coating: +24% PVC | LOI = 30%:<br>no shading<br>no desheathing<br>fire retardant content reduced by about 60%<br>fire retardant content = 10%<br>no chimney effect<br>$1^{st}$ coating: +41% PVC<br>$2^{nd}$ coating: +30% PVC |
| Properties of the fabric | M1 B1<br>Slightly shaded<br>Slight desheathing (sheath fracturing under mechanical stress) | M1 maintained and more uniform<br>B1 Constancy of mechanical properties under stress (glass yarn not destroyed)<br>No shading<br>No desheathing<br>No defibrillation<br>No capillary effect |

In an alternative, the degree of application may be varied between 30 and 70%.

In an alternative, the coating according to the invention does comprise in the $1^{st}$ coating a filler (fire-retardant). The filler coating is 0.1-25 phr, preferably 5-25 phr.

The degree of application is the amount of impregnation of the yarn—it is defined by the following formula:

$$\frac{\text{weight of the coated yarn} - \text{weight of the yarn}}{\text{weight of the coated yarn}} \times 100;$$

LOI represents the Limited Oxygen Index—it is determined according to the NF G 07128 standard.

To prepare formulations according to the invention, based on a chlorinated polymer such as PVC, the following ingredients were used by way of example:

Resins:

a. PVC Resin

VINNOLIT P4472, VINNOLIT P70, VINNOLIT P70 PS (Vinnolit), SELIN 372 No. (Selvan);

b. Filler Resin

LACOVYL B 1050 (Atofina) or SOLVIN 266 SC, VINNOLIT C65V (Vinnolit), VINNOLIT C66 (Vinnolit), C66W.

Plasticizers:

DINP (JAYFLEX DINP, PALATINOL N (BASF), VESTINOL 9 (Oxeno)), TXIB (Eastman TXIB), DIDP (JAYFLEX DIDP (Exxon), PALATINOL Z (BASF)), BBP (SANTICIZER 206) (Ferro), DINCH (BASF).

Stabilizers:

a. Heat Stabilizers based on Pb (BAEROSTAB V 220) (Baerlocher)

based on barium and zinc organic salts (LASTAB DC 261 GL (Lagor), MARK BZ 561 (Witco))

based on thiotin (BAEROSTAB M62 A (Baerlocher))

b. UV Stabilizer

Benzotriazole or benzophenone (TINUVIN 320, TINUVIN 571, TINUVIN P (Witco)).

Fillers:

Opacifying fillers: zinc sulfide ZnS (SACHTOLIT L (Sachtleben)), titanium dioxide (Kronos).

Fire Retardants:

Zinc borate (FIREBREAK ZB (US Borax))

Aluminum hydroxide (Alumina SH 5) (Omya)

Antimony trioxide (antimony oxide/TIMONOX) (Sica, Campine, plc)

Zinc hydroxystannate (STORMFLAM ZHS (Joseph Storey).

Additives:

Viscosity modifiers/rheology agents: VISCOBYK-4013, CAB-O-SIL, EXXSOL D80 (Byk-Chemie, Cabot, Exxon).

Wetting agents: DISPERPLAST-1142 (Byk-Chemie).

Since glass favors heat dissipation, the phenomenon of flame propagation encountered in fire tests according to the NF 92503 standard on fabrics is, with a fabric obtained by weaving a fire-retarded yarn according to the invention, greatly reduced as the polymer material is better distributed within the core of the fibers and the stored heat is therefore better dissipated by the fibers.

This dissipation optimization makes it possible overall to reduce the content of fire-retardant fillers in the coated fire-retarded composite yarn.

The following examples illustrate the invention in the particular case of the use of a silicone-based polymer material.

A halogen-free coated fire-retarded composite yarn according to the invention was obtained by coating a mineral yarn/continuous glass fiber/continuous glass filament according to the process of the invention, that is to say by mechanically opening the yarn, by splaying it, simultaneously with or prior to the coating operation with a liquid polymer preparation based on a silicone polymer.

The coating formulation was defined by a viscosity between 500 and 10 000 mPa·s and preferably between 1 000 and 5 000 mPa·s, measured at 25 .degree. C. using a Brookfield RVT viscometer at 20 rpm with a No. 4 spindle.

The coating was carried out with a formulation comprising the following products:

Silicone . . . 100 phr
Solvent/water . . . 0 to 50 phr
Fillers (pigment, fire retardant, etc.) . . . 0 to 20 phr
Crosslinking agent . . . 2 to 6 phr
Additives . . . 0 to 5 phr
Additives . . . 0 to 5 phr.

The silicones used were, for example:

ELASTOSIL RD6635, RD 3151 or 45539 WP (Wacker), RHODOSIL RTV 1519 (Rhodia), DOW FC227TS (Dow Corning), 9050/30P from Dow Corning, 6600 F from Wacker, SILASTIC LPX from Dow Corning, SILICOLEASE UV POLY 200 and UV CATA 211 from Rhodia.

The diluents were chosen from toluene, xylene, white spirit and water.

The fillers consisted for example of FIREBREAK ZB zinc borate, aluminum hydroxide (Omya), SH5n alumina, promoter such as ELASTOSIL 45568 VP or HF86 (Wacker), retarder HTV-SB (Wacker), water-repellent agent WS60E (Wacker) or glass beads (Sovitec), RAL pigmentary paste from Wacker.

The following formulations were made and composite yarns according to the invention obtained by coating.

EXAMPLE 1

First coating: 30% degree of application
9050/30P from Dow Corning
(3 000 cP viscosity) . . . 100 phr
Second coating, 30% degree of application
9050/30P . . . 100 phr
SILASTIC (Dow Corning) . . . 2 phr

EXAMPLE 2

First coating, 15% degree of application
9050/30P from Dow Corning
Second coating, 15% degree of application
RD3151 (Wacker) . . . 100 phr
HTV-SB Batch 2 (Wacker) . . . 0.5 phr
FIREBREAK Zn borate . . . 5 phr
RAL pigmentary paste (Wacker) . . . 2 phr
ELASTOSIL W crosslinking agent (Wacker) . . . 3 phr

EXAMPLE 3

Single coating 18% degree of application
6600 F (Wacker) . . . 100 phr
HTV-SB Batch 2 (Wacker) . . . 1 phr
ATH (Alcan) . . . 20 phr
ELASTOSIL W crosslinking agent (Wacker) . . . 5 phr
Toluene 20 . . . phr

EXAMPLE 4

The silicones used were UV-crosslinkable.
First coating:
SILICOLEASE UV POLY 200 (Rhodia) . . . 100 parts
SILICOLEASE UV CATA 211 (Rhodia) . . . 2 to 5 parts
Second coating:
SILICOLEASE UV POLY 200 (Rhodia) . . . 100 parts
SILICOLEASE UV CATA 211 (Rhodia) . . . 2 to 5 parts
Fire-retarding fillers
Pigment.

The invention can also been illustrated in the particular case of the use of a PVC based polymer material. The coating was carried out with a formulation comprising the following products:

PVC resin=100 phr
Plasticizer=30-50 phr
Fillers (pigments, fire retardant . . . )=15-25 phr
Stabilizers (UV, thermical . . . )=5 phr
Additives=5 phr
Diluant=2-6 phr;

PVC: VINNOL P4472 (VINNOLIT), PB 1302 (ARKEMA), SOLVIN 372 NF (SOLVIN), 266 SC (SOLVIN), VINNOL C66W or C65 FV (VINNOLIT)

Plasticizer: PALATINOL (BASF), TXIB (EASTMAN), BBP (FERRO) or DINCH (BASF)

Fillers: TIMONOX, BORAX, FLAMETARD H, APYRAL 4, Magnesium hydroxide, Sachtolit or KRONOS 2222

Additives: BYK products (B1142, B1150, Disperplast I and O) or SOLPLUS K500

Stabilisers: TINUVIN 320 (CIBA), MARK BZ561 (BARLOCHER) or CZ 314 (MEMOLEX)

EXAMPLE 5 first coating=30% degree of application
SOLVIN 372 NF=100 phr
DINP=40 phr
APYRAL 4 (ATH)=10 phr
Stabiliser CZ314=3 phr
Additive Disperplast I=2 phr
second coating=25% degree of application
VINNOL P4472=100 phr
DINP=50 phr
Fillers: $Sb_2O_3$/BoZn=20 phr
Stabiliser lastab S-CP 816=5 phr
Stabiliser TINUVIN 320=2 phr
Additives SOLPLUS K500=2 phr
Diluant=4 phr The fabrics obtained with a composite yarn according to the invention require no subsequent treatment in order to improve their fire behavior.

A composite yarn according to the invention exhibits no defibrillation on cutting, it is more hydrophobic and it is "softer" to the touch; the textiles obtained by weaving are stain-resistant.

A composite yarn according to the present invention can be incorporated into any textile structure, or assembled as any required textile structure, whether two-dimensional (webs, fabrics, etc.) or three-dimensional (for example braids).

The textiles obtained with the composite yarn of the present invention are much more resistant than textiles obtained with standard yarns of the prior art that does not comprise a coating of the fibers inside the yarn. A textile obtained with the yarns of the present invention and standard textile were submitted to folding under a 4 kg weight. It appears that the textile obtained with yarns of the present invention can undergo 100 000 cycles before breaking whereas standard textiles undergo only 75 000 cycles.

The composite yarn may firstly be cut and divided into elementary yarns, which can be intermingled and fastened to one another, in the form of nonwoven textile structures, for example mats. The intermingled elementary yarns may be fastened by impregnation with a suitable adhesive substance, or by the thermal melting of the polymer material of the sheath.

The composite yarn may then be assembled on itself in any suitable knitted textile structure, but it may also be assembled with other yarns, whether or not according to the present invention, in order to constitute various two-dimensional or three-dimensional structures; in the latter case, these may be meshes in which the yarns according to the present invention are interlaced with and fastened to other yarns, whether or not according to the present invention, and fabrics in which the composite yarns according to the invention are woven with other warp and/or weft yarns, again whether or not according to the invention.

A very particular application of the present invention relates to the production of technical fabrics intended for the production or manufacture of both interior and exterior blinds or curtains.

After fire tests, all these fabrics have shown that they meet both the German regulations with class B1 and the French regulations with class M1 and F3.

What is claimed is:

1. A process for manufacturing a composite yarn, comprising:

subjecting a continuous yarn, obtained by spinning a large plurality of fibers made of an organic material or silica or glass, to a process for mechanically opening the yarn by splaying, to uniformly spread out and separate the fibers, including inner layers of the fibers, without impairing functional properties of the yarn;

coating the fibers with a primary coating consisting of plastisol that consists essentially of a dispersion of a chlorinated polymer material selected from the group consisting of polyvinyl chloride, superchlorinated PVCs, polyvinylidene chlorides, and chlorinated polyolefins, a plasticizer, and a fire-retarding filler, the coating having a viscosity between 1000 and 2000 mPa·s measured at 25° C. using a Brookfield RVT viscometer at 20 rpm with a No. 4 spindle, simultaneously with or after subjecting the continuous yarn to the process for mechanically opening the yarn by splaying; and forming a composite yarn having a circular cross-section and uniformly distributed fibers throughout the cross-section of the polymer material to limit desheathing of the yarn.

2. The process as claimed in claim 1, wherein the fibers are made of glass.

3. The process as claimed in claim 1, wherein the chlorinated polymer material is polyvinyl chloride.

4. The process as claimed in claim 1, wherein the splaying is by at least one of air jet, water jet, ultrasonic or vibratory treatment.

5. The process as claimed in claim 1, wherein the step of forming to have a uniform distribution increases heat dissipation to reduce flame propagation.

6. The process as claimed in claim 1, wherein the plurality of fibers contains about 200 to 600 fibers.

7. The process as claimed in claim 1, wherein each fiber has a diameter of between about 1 to 10 micrometers.

8. A process for manufacturing a composite yarn, comprising:

subjecting a continuous yarn, obtained by spinning a large number of fibers made of an organic material or silica or glass, to a process for mechanically opening the yarn by splaying, to uniformly spread out and separate the fibers, including inner layers of the fibers, without impairing functional properties of the yarn, coating the fibers with a primary coating consisting of plastisol that consists essentially of a dispersion of a chlorinated polymer preparation selected from the group consisting of polyvinyl chloride, superchlorinated PVCs, polyvinylidene chlorides and chlorinated polyolefins, a plasticizer, and a fire-retarding filler, the primary coating having a viscosity between 1000 and 2000 mPa·s measured at 25° C. using a Brookfield RVT viscometer at 20 rpm with a No. 4 spindle, after subjecting the continuous yarn to the process for mechanically opening the yarn by splaying; and forming a composite yarn having a circular cross-section and uniformly distributed fibers throughout the cross-section of the monomer or polymer preparation to limit desheathing of the yarn; and subjecting the composite yarn obtained to a second coating with a second liquid monomer or polymer preparation having a viscosity between 1000 and 2000 mPa·s measured at 25° C. using a Brookfield RVT viscometer at 20 rpm with a No. 4 spindle.

9. The process according to claim 8, wherein the second coating contains a fire-retarding filler.

10. The process as claimed in claim 9, wherein the fire-retarding filler is chosen from the group consisting of zinc borate, aluminum hydroxide, antimony trioxide and zinc hydroxystannate.

11. The process as claimed in claim 8, wherein the monomer or polymer of the second coating is of the same nature as the monomer or polymer of the first coating.

12. The process as claimed in claim 8, further comprising forming a textile structure from the composite yarn.

13. The process as claimed in claim 8, wherein the splaying is by at least one of air jet, water jet, ultrasonic or vibratory treatment.

14. The process as claimed in claim 8, wherein the step of forming to have a uniform distribution increases heat dissipation to reduce the flame propagation.

15. The process according to claim 8, wherein the large number of fibers is about 200 to 600 fibers.

16. The process according to claim 15, wherein each fiber has a diameter of about 1 to 10 micrometers.

17. The process as claimed in claim 1, further comprising subjecting the composite yarn obtained to a second coating with a second polymer material having a viscosity between 1000 and 2000 mPa·s measured at 25° C. using a Brookfield RVT viscometer at 20 rpm with a No. 4 spindle.

18. The process as claimed in claim 17, wherein the polymer of the second coating is of the same nature as the polymer of the primary coating.

19. The process as claimed in claim 1, further comprising forming a textile structure from the composite yarn.

20. The process as claimed in claim 1, wherein the fibers are made of silica.

21. The process as claimed in claim 1, wherein the fibers are made of polyester.

22. A process for manufacturing a composite yarn, comprising:

subjecting a continuous yarn, obtained by spinning a large plurality of fibers made of an organic material or silica or glass, to a process for mechanically opening the yarn by splaying, to uniformly spread out and separate the fibers, including inner layers of the fibers, without impairing functional properties of the yarn;

coating the fibers with a primary coating consisting of a chlorinated polymer selected from the group consisting of polyvinyl chloride, superchlorinated PVCs, polyvinylidene chlorides, and chlorinated polyolefins, a plasticizer, a fire-retarding filler, and optionally additives selected from the group consisting of other fillers, wetting agents, and diluents, the primary coating having a viscosity between 1000 and 2000 mPa·s measured at 25° C. using a Brookfield RVT viscometer at 20 rpm with a No. 4 spindle, simultaneously with or after subjecting the continuous yarn to the process for mechanically opening the yarn by splaying; and forming a composite yarn having a circular cross-section and uniformly distributed fibers throughout the cross-section of the polymer material to limit desheathing of the yarn.

* * * * *